US005409792A

United States Patent [19]

Yanus et al.

[11] Patent Number: 5,409,792

[45] Date of Patent: Apr. 25, 1995

[54] PHOTORECEPTOR CONTAINING DISSIMILAR CHARGE TRANSPORTING SMALL MOLECULE AND CHARGE TRANSPORTING POLYMER

[75] Inventors: John F. Yanus, Webster; Damodar M. Pai, Fairport; William W. Limburg, Penfield; Dale S. Renfer, Webster, all of N.Y.

[73] Assignee: Xerox Corporation, Stamford, Conn.

[21] Appl. No.: 328,320

[22] Filed: Oct. 24, 1994

Related U.S. Application Data

[63] Continuation of Ser. No. 66,184, May 21, 1993, abandoned, which is a continuation-in-part of Ser. No. 749,828, Aug. 26, 1991, abandoned.

[51] Int. Cl.[6] ..... G03G 5/047

[52] U.S. Cl. ..... 430/59

[58] Field of Search ..... 430/58, 59

[56] References Cited

U.S. PATENT DOCUMENTS

| | | | |
|---|---|---|---|
| 3,121,006 | 2/1964 | Middleton et al. . | |
| 3,357,989 | 12/1967 | Byrne et al. . | |
| 3,442,781 | 5/1969 | Weinberger . | |
| 4,007,043 | 2/1977 | Stolka et al. | 430/58 |
| 4,025,341 | 5/1977 | Rule . | |
| 4,265,990 | 5/1981 | Stolka et al. | 430/59 |
| 4,286,033 | 8/1981 | Neyhart et al. | 430/58 |
| 4,291,110 | 9/1981 | Lee | 430/59 |
| 4,338,387 | 7/1982 | Hewitt | 430/58 |
| 4,388,392 | 6/1983 | Kato et al. | 430/58 |
| 4,405,704 | 9/1983 | Watardi et al. | 430/74 |
| 4,415,639 | 11/1983 | Horgan | 430/57 |
| 4,582,772 | 4/1986 | Teuscher et al. | 430/58 |
| 4,801,517 | 1/1989 | Frechet et al. | 430/59 |
| 4,806,443 | 2/1989 | Yanus et al. | 430/56 |
| 4,806,444 | 2/1989 | Yanus et al. | 430/56 |
| 4,818,650 | 4/1989 | Limburg et al. | 430/56 |
| 4,871,634 | 10/1989 | Limburg et al. | 430/54 |
| 4,933,245 | 6/1990 | Akasaki et al. | 430/59 |
| 4,935,487 | 6/1990 | Yanus et al. | 528/203 |
| 4,937,165 | 6/1990 | Ong et al. | 430/59 |
| 4,956,440 | 9/1990 | Limburg et al. | 528/99 |
| 4,959,288 | 9/1990 | Ong et al. | 430/59 |
| 4,983,482 | 1/1991 | Ong et al. | 430/59 |
| 5,030,532 | 7/1991 | Limburg et al. | 430/56 |
| 5,034,296 | 7/1991 | Ong et al. | 430/59 |
| 5,262,512 | 11/1993 | Yanus et al. | 528/181 |
| 5,283,143 | 2/1994 | Yanus et al. | 430/59 |
| 5,316,880 | 5/1994 | Pai et al. | 430/59 |
| 5,356,743 | 10/1994 | Yanus et al. | 430/59 |

FOREIGN PATENT DOCUMENTS 0189991 8/1986, European Pat. Off. .

*Primary Examiner*—Roland Martin

[57] ABSTRACT

An electrophotographic imaging member including a charge generating layer and a charge transport layer, the charge transport layer comprising a charge transporting small molecule dissolved or molecularly dispersed in a film forming charge transporting polymer comprising charge transporting moieties in the backbone of the film forming charge transporting polymer, the charge transporting moieties having a structure unlike the structure of the charge transporting small molecule, the ionization potential of the charge transporting small molecule and the charge transporting moieties having a difference in ionization potential value of less than about 0.05 electron volt, the charge transporting small molecule and the charge transporting polymer being non-absorbing to radiation in the region of intended use, and the charge transport layer being substantially free of electrically inactive film forming binder. This imaging member may be employed in an electrophotographic imaging process.

9 Claims, No Drawings

PHOTORECEPTOR CONTAINING DISSIMILAR CHARGE TRANSPORTING SMALL MOLECULE AND CHARGE TRANSPORTING POLYMER

This is a continuation of application Ser. No. 08/066,184, filed May 21, 1993, now abandoned, which is a continuation-in-part application of Ser. No. 07/749,828, filed Aug. 26, 1991, now abandoned.

BACKGROUND OF THE INVENTION

This invention relates in general to electrophotographic imaging members and more specifically, to imaging members having an improved charge transport layer and process for using the imaging members.

In the art of electrophotography an electrophotographic plate comprising a photoconductive insulating layer on a conductive layer is imaged by first uniformly electrostatically charging the imaging surface of the photoconductive insulating layer. The plate or photoreceptor is then exposed to a pattern of activating electromagnetic radiation such as light, which selectively dissipates the charge in the illuminated areas of the photoconductive insulating layer while leaving behind an electrostatic latent image in the non-illuminated area. This electrostatic latent image may then be developed to form a visible image by depositing finely divided toner particles on the surface of the photoconductive insulating layer. The resulting visible toner image can be transferred to a suitable receiving member such as paper. This imaging process may be repeated many times with reusable photoconductive insulating layers.

One common type of photoreceptor is a multilayered device that comprises a conductive layer, a charge generating layer, and a charge transport layer. Either the charge generating layer or the charge transport layer may be located adjacent the conductive layer. The charge transport layer can contain an active aromatic diamine small molecule charge transport compound dissolved or molecularly dispersed in a film forming binder. This type of charge transport layer is described, for example in U.S. Pat. No. 4,265,990. Although excellent toner images may be obtained with such multilayered photoreceptors, it has been found that when high concentrations of active aromatic diamine small molecule charge transport compound are dissolved or molecularly dispersed in a film forming binder the small molecules tend to crystallize with time under conditions such as higher machine operating temperatures, mechanical stress or exposure to chemical vapors. Such crystallization can cause undesirable changes in the electro-optical properties, such as residual potential build-up which can cause cycle-up. Moreover, the range of binders and binder solvent types available for use during coating operations is limited when high concentrations of the small molecules are sought for the charge transport layer. For example, active aromatic diamine small molecules do not disperse in polyurethane binders. Limited selection of binders and binder solvents can affect the life and stability of a photoreceptor under extended cycling conditions. Moreover, such limited selection also affects the choice of binders and solvents used in subsequently applied layers. For example, the solvents employed for subsequently applied layers should not adversely affect any of the underlying layers. This solvent attack problem is particularly acute in dip coating processes. Further, some of the solvents that are commonly utilized, such as methylene chloride, are marginal solvents from the point of view of environmental toxicity.

Another type of charge transport layer has been developed which utilizes a charge transporting polymer. This type of charge transport polymer includes materials such as poly N-vinyl carbazole, polysilylenes, and others including those described in U.S. Pat. No. 4,806,443, U.S. Pat. No. 4,806,444, U.S. Pat. No. 4,818,650, U.S. Pat. No. 4,935,487, and U.S. Pat. No. 4,956,440. Some polymeric charge transporting materials have relatively low charge carrier mobilities. Moreover, the cost of charge transporting polymers having high concentrations of charge transporting moieties in the polymer chain can be very costly. Further, the mechanical properties of charge transporting polymers such as wearability, hardness and craze resistance are reduced when the relative concentration of charge transporting moieties in the chain is increased.

Thus, in imaging systems utilizing multilayered photoreceptors containing charge transporting layers, adverse effects may be encountered during extended photoreceptor cycling. This can reduce the practical value of multilayered photoreceptors that are cycled many times in automatic devices such as electrophotographic copiers, duplicators and printers.

INFORMATION DISCLOSURE STATEMENT

U.S. Pat. No. 4,933,245 to Akasaki et al., issued Jun. 12, 1990—An electrophotographic photoreceptor is disclosed which comprises an electrically conductive support having provided thereon a photoconductive layer containing, as a charge transport material, a diamine small molecule represented by a specific structural formula. The photoreceptor satisfies both electrical and mechanical requirements without undergoing adverse influences from binder resins used therein.

U.S. Pat. No. 4,806,444 to Yanus et al., issued Feb. 21, 1989—An electrostatographic imaging member and electrostatographic imaging process are disclosed in which the imaging member comprises a polymeric arylamine compound represented by a specific formula. Various activating small molecule materials are described, for example in columns 2 through 4. Also, polymeric arylamine compounds are mentioned in column 3. Parts or all of the transport material comprising a hole transporting small molecule in an inactive binder for a transport layer may be replaced by active polymeric arylamine compounds as described, for example, in column 17, lines 23 through 33.

U.S. Pat. No. 4,806,443 to Yanus et al., issued Feb. 21, 1989—An electrophotographic imaging member and an electrophotographic process are disclosed in which the imaging member comprises a polymeric arylamine compound represented by a specific formula. The imaging member may comprise a substrate, charge generation layer and a charge transport layer. Activating small molecules such arylamine containing compounds are disclosed, for example, in columns 2 through 4. Part or all of the transport material comprising a hole transporting small molecule in an inactive binder to be employed in a transport layer may be replaced by active polymeric acrylamine compounds as disclosed, for example, in column 17, lines 45 through 55.

U.S. Pat. No. 4,818,650 to Limburg et al, issued Apr. 4, 1989—An electrostatographic imaging member and electrostatographic imaging process are disclosed in which the imaging member comprises a polymeric arylamine compound represented by a specific formula.

Various activating small molecules are described, for example, in columns 2 through 4. Polymeric arylamine molecules are mentioned in column 3. Part or all of the transport material comprising a hole transporting small molecule in an inactive binder or a transport may be replaced by a polymeric arylamine film forming material as described, for example, in column 26, lines 11 through 21.

U.S. Pat. No. 4,935,487 to Yanus et al., issued Jun. 19, 1990—A polymeric arylamine having a specific formula is disclosed. Various activating small molecule materials such as arylamine compounds are described, for example in columns 2 through 4. Polymeric arylamine molecules are mentioned in column 3. Part or all of the transport material comprising a hole transporting small molecule in an inactive binder for a transport layer may be replaced by active polymeric arylamine film forming material as described, for example, in column 16, lines 20 through 30.

U.S. Pat. No. 4,956,440 to Limburg et al., issued Sep. 11, 1990—Polymeric tertiary arylamine compounds of the phenoxy resin type are disclosed for electrophotographic imaging. Various activating small molecule materials such as arylamine compounds are described, for example in columns 2 through 4. Polymeric arylamine molecules are mentioned in column 3. Part or all of the transport material comprising a hole transporting small molecule in an inactive binder for a transport layer may be replaced by polymeric tertiary arylamine compounds of the phenoxy resin type as described, for example, in column 24, lines 44 through 54.

U.S. Pat. No. 4,801,517 to Frechet et al., issued Jan. 31, 1989—An electrostatographic imaging member and electrostatographic process are disclosed in which the imaging member comprises a polymeric arylamine compound having a specific formula. Various activating small molecule materials such as arylamine compounds are described, for example in columns 2 through 4. Polymeric arylamine molecules are mentioned in column 3. Part or all of the transport material comprising a hole transporting small molecule in an inactive binder for a transport layer may be replaced by the polymeric amine compound, e.g., see column 17, lines 1 through 11.

U.S. Pat. No. 4,983,482 to Ong et al, issued Jan. 8, 1991—A layered photoresponsive imaging member comprised of a photogenerating layer, and in contact therewith a hole transporting layer comprised of charge transport polyurethanes having a specific formula, optionally doped with a charge transport compound, or optionally dispersed in an inert resinous binder, e.g. see claims 1, 16 and Example 8.

U.S. Pat. No. 4,959,288 to Ong et al, issued Sep. 25, 1990—A photoconductive imaging member comprised of a photogenerating layer, and a charge transport layer comprised of diaryl biarylylamine copolymers having a specific formula. The charge transport layer may be doped with a charge transport molecule, e.g. see column 13, lines 42–65; column 14, lines 53–65; Example 10; and claims 2 and 26.

U.S. Pat. No. 5,034,296 to Ong et al, issued Jul. 23, 1991—A layered photoresponsive imaging member comprised of a photogenerating layer, and in contact therewith a hole transporting layer comprised of fluorene charge transport polyesters having specific formulas. The charge transport layer may be doped with a charge transport molecule, e.g. see column 8, lines 31–48; column 9, lines 39–40; Example 9; and claims 1 and 14.

U.S. Pat. No. 4,937,165 to Ong et al, issued Jun. 26, 1990—A photoconductive imaging member comprised of a photogenerating layer, and a charge transport layer comprised of the N,N-bis(biarylyl)aniline charge transport polymers having a specific formula. The charge transport layer may be doped with a charge transport molecule, e.g. see column 13, lines 12–27; Example 9; and claims 1 and 26.

U.S. Pat. No. 4,582,772 to Teuscher et al., issued Apr. 15, 1986—A photoresponsive device is disclosed comprising charge carrier transport layer comprising the combination of a resinous binder having dispersed therein small molecules of an electrically active arylamine small molecule.

U.S. Pat. No. 4,265,990, issued to Stolka et al. on May 5, 1981 A photosensitive member is disclosed having photoconductive layer and a charge transport layer, the charge transport layer containing an aromatic diamine in an inactive film forming binder.

U.S. Pat. No. 4,871,634 to Limburg et al., issued Oct. 3, 1989—A hydroxyl arylamine compound having a specific formula is disclosed. The arylamine compound may be employed in an electrophotographic imaging member and imaging process. Various activating small molecules and polymeric arylamine contain molecules are described, for example, in columns 2 through 4. The hydroxyl arylamine may be bound by hydrogen binding to a resin capable of hydrogen bounding and incorporated into layers such as a charge transport layer.

Excellent toner images may be obtained with multilayered photoreceptors in which the charge transport layer contains a charge transporting polymer. However, it has been found that if a charge transporting polymer is mixed with a transporting small molecule in an inactive binder for a transport layer, xerographic performance is very poor as a result of trapping of carriers in the transport layer. This increases the residual potential, thus lowering the useful contrast potential. Furthermore when such a photoreceptor is cycled in a xerographic machine, a condition known as cycle-up results. The residual potential increases and causes the background area densities to increase thereby creating unacceptable images.

Thus, there is a continuing need for electrophotographic imaging members having improved electrical performance and resistance to degradation during extended cycling.

SUMMARY OF THE INVENTION

It is, therefore, an object of the present invention to provide an improved electrophotographic imaging member which overcomes the above-noted disadvantages.

It is another object of the present invention to provide an electrophotographic imaging member which avoids crystallization at high concentrations of small molecule charge transport compounds It is still another object of the present invention to provide an electrophotographic imaging member exhibiting improved imaging operation during extended image cycling.

It is yet another object of the present invention to provide an electrophotographic imaging member possessing improved integrity of layers underlying the charge transport layer.

It is another object of the present invention to provide an electrophotographic imaging member that exhibits high charge carrier mobilities.

It is still another object of the present invention to provide an electrophotographic imaging member that exhibits greater wearability, hardness and craze resistance with high concentrations of charge transporting moieties in a charge transporting polymer.

It is yet another object of the present invention to provide an electrophotographic imaging member which can be coated employing a variety of solvents.

It is still another object of this present invention to provide an electrophotographic imaging member containing either particle contact or dispersed pigment charge generator layers.

The foregoing objects and others are accomplished in accordance with this invention by providing an electrophotographic imaging member comprising a charge generating layer and a charge transport layer, the charge transport layer comprising a charge transporting small molecule dissolved or molecularly dispersed in a film forming charge transporting polymer comprising charge transporting moieties in the backbone of the film forming charge transporting polymer, the charge transporting moieties having a structure unlike the structure of the charge transporting small molecule, the ionization potential of the charge transporting small molecule and the charge transporting moieties having a difference in ionization potential value of less than about 0.05 electron volt, the charge transporting small molecule and the charge transporting polymer being non-absorbing to radiation in the region of intended use, and the charge transport layer being substantially free of electrically inactive film forming binder. This imaging member may be employed in an electrophotographic imaging process.

Electrostatographic imaging members are well known in the art. Electrostatographic imaging members may be prepared by various suitable techniques. Typically, a flexible or rigid substrate is provided having an electrically conductive surface. A charge generating layer is then applied to the electrically conductive surface. A charge blocking layer may be applied to the electrically conductive surface prior to the application of the charge generating layer. If desired, an adhesive layer may be utilized between the charge blocking layer and the charge generating layer. Usually the charge generation layer is applied onto the blocking layer and a charge transport layer is formed on the charge generation layer. However, in some embodiments, the charge transport layer is applied prior to the charge generation layer.

The substrate may be opaque or substantially transparent and may comprise numerous suitable materials having the required mechanical properties. Accordingly, the substrate may comprise a layer of an electrically non-conductive or conductive material such as an inorganic or an organic composition. As electrically non-conducting materials there may be employed various resins known for this purpose including polyesters, polycarbonates, polyamides, polyurethanes, and the like which are flexible as thin webs. The electrically insulating or conductive substrate may be in the form of an endless flexible belt, a web, a rigid cylinder, a sheet and the like.

The thickness of the substrate layer depends on numerous factors, including strength desired and economical considerations. Thus, this layer for a flexible belt may be of substantial thickness, for example, about 125 micrometers, or of minimum thickness less than 50 micrometers, provided there are no adverse effects on the final electrostatographic device. The surface of the substrate layer is preferably cleaned prior to coating to promote greater adhesion of the deposited coating. Cleaning may be effected, for example, by exposing the surface of the substrate layer to plasma discharge, ion bombardment and the like.

The conductive layer may vary in thickness over substantially wide ranges depending on the optical transparency and degree of flexibility desired for the electrostatographic member. Accordingly, for a flexible photoresponsive imaging device, the thickness of the conductive layer may be between about 20 angstrom units to about 750 angstrom units, and more preferably from about 100 Angstrom units to about 200 angstrom units for an optimum combination of electrical conductivity, flexibility and light transmission. The flexible conductive layer may be an electrically conductive metal layer formed, for example, on the substrate by any suitable coating technique, such as a vacuum depositing technique. Typical metals include aluminum, zirconium, niobium, tantalum, vanadium and hafnium, titanium, nickel, stainless steel, chromium, tungsten, molybdenum, and the like. In general, a continuous metal film can be attained on a suitable substrate, e.g. a polyester web substrate such as Mylar available from E. I. du Pont de Nemours & Co. with magnetron sputtering.

If desired, an alloy of suitable metals may be deposited. Typical metal alloys may contain two or more metals such as zirconium, niobium, tantalum, vanadium and hafnium, titanium, nickel, stainless steel, chromium, tungsten, molybdenum, and the like, and mixtures thereof. A typical electrical conductivity for conductive layers for electrophotographic imaging members in slow speed copiers is about $10^2$ to $10^3$ ohms/square.

After formation of an electrically conductive surface, a hole blocking layer may be applied thereto for photoreceptors. Generally, electron blocking layers for positively charged photoreceptors allow holes from the imaging surface of the photoreceptor to migrate toward the conductive layer. Any suitable blocking layer capable of forming an electronic barrier to holes between the adjacent photoconductive layer and the underlying conductive layer may be utilized. The blocking layer may be nitrogen containing siloxanes or nitrogen containing titanium compounds such as trimethoxysilyl propylene diamine, hydrolyzed trimethoxysilyl propyl ethylene diamine, N-beta-(aminoethyl) gamma-aminopropyl trimethoxy silane, isopropyl 4-aminobenzene sulfonyl, di(dodecylbenzene sulfonyl) titanate, isopropyl di(4-aminobenzoyl)isostearoyl titanate, isopropyl tri(N-ethylamino-ethylamino)titanate, isopropyl trianthranil titanate, isopropyl tri(N,N-dimethylethylamino)titanate, titanium-4-amino benzene sulfonat oxyacetate, titanium 4-aminobenzoate isostearate oxyacetate, $[H_2N(CH_2)_4]CH_3Si(OCH_3)_2$, (gamma-aminobutyl) methyl diethoxysilane, and $[H_2N(CH_2)_3]CH_3Si(OCH_3)_2$ (gamma-aminopropyl) methyl diethoxysilane, as disclosed in U.S. Pat. Nos. 4,338,387, 4,286,033 and 4,291,110. The disclosures of U.S. Pat. Nos. 4,338,387, 4,286,033 and 4,291,110 are incorporated herein in their entirety. A preferred blocking layer comprises a reaction product between a hydrolyzed silane and the oxidized surface of a metal ground plane layer. The blocking layer may be applied by any suitable conventional technique such as spraying, dip coating, draw bar coating, gravure coating, silk screening, air knife coating, reverse roll coating, vacuum deposition, chemical treatment and the like. The blocking layer should be continuous and have a thickness of less than about 0.2 micrometer because greater thicknesses may lead to undesirably high residual voltage.

An optional adhesive layer may applied to the hole blocking layer. Any suitable adhesive layer well known in the art may be utilized. Typical adhesive layer materials include, for example, polyesters, duPont 49,000 (available from E. I. duPont de Nemours and Company), Vitel PE 100 (available from Goodyear Tire & Rubber), polyurethanes, and the like. Satisfactory results may be achieved with adhesive layer thickness between about 0.05 micrometer (500 angstroms) and about 0.3 micrometer (3,000 angstroms). Conventional techniques for applying an adhesive layer coating mixture to the charge blocking layer include spraying, dip coating, roll coating, wire wound rod coating, gravure coating, Bird applicator coating, and the like. Drying of the deposited coating may be effected by any suitable conventional technique such as oven drying, infra red radiation drying, air drying and the like.

Any suitable photogenerating layer may be applied to the adhesive blocking layer which can then be overcoated with a contiguous hole transport layer as described hereinafter. Examples of typical photogenerating layers include inorganic photoconductive particles such as amorphous selenium, trigonal selenium, and selenium alloys selected from the group consisting of selenium-tellurium, selenium-tellurium-arsenic, selenium arsenide and mixtures thereof, and organic photoconductive particles including various phthalocyanine pigment such as the X-form of metal free phthalocyanine described in U.S. Pat. No. 3,357,989, metal phthalocyanines such as vanadyl phthalocyanine and copper phthalocyanine, dibromoanthanthrone, squarylium, quinacridones available from DuPont under the tradename Monastral Red, Monastral violet and Monastral Red Y, Vat orange 1 and Vat orange 3 trade names for dibromo anthanthrone pigments, benzimidazole perylene, substituted 2,4-diamino-triazines disclosed in U.S. Pat. No. 3,442,781, polynuclear aromatic quinones available from Allied Chemical Corporation under the tradename Indofast Double Scarlet, Indofast Violet Lake B, Indofast Brilliant Scarlet and Indofast Orange, and the like dispersed in a film forming polymeric binder. Multi-photogenerating layer compositions may be utilized where a photoconductive layer enhances or reduces the properties of the photogenerating layer. Examples of this type of configuration are described in U.S. Pat. No. 4,415,639, the entire disclosure of this patent being incorporated herein by reference. Other suitable photogenerating materials known in the art may also be utilized, if desired. Charge generating binder layers comprising particles or layers comprising a photoconductive material such as vanadyl phthalocyanine, metal free phthalocyanine, benzimidazole perylene, amorphous selenium, trigonal selenium, selenium alloys such as selenium-tellurium, selenium-tellurium-arsenic, selenium arsenide, and the like and mixtures thereof are especially preferred because of their sensitivity to white light. Vanadyl phthalocyanine, metal free phthalocyanine and tellurium alloys are also preferred because these materials provide the additional benefit of being sensitive to infra-red light.

Any suitable polymeric film forming binder material may be employed as the matrix in the photogenerating binder layer. Typical polymeric film forming materials include those described, for example, in U.S. Pat. No. 3,121,006, the entire disclosure of which is incorporated herein by reference. Thus, typical organic polymeric film forming binders include thermoplastic and thermosetting resins such as polycarbonates, polyesters, polyamides, polyurethanes, polystyrenes, polyarylethers, polyarylsulfones, polybutadienes, polysulfones, polyethersulfones, polyethylenes, polypropylenes, polyimides, polymethylpentenes, polyphenylene sulfides, polyvinyl acetate, polysiloxanes, polyacrylates, polyvinyl acetals, polyamides, polyimides, amino resins, phenylene oxide resins, terephthalic acid resins, phenoxy resins, epoxy resins, phenolic resins, polystyrene and acrylonitrile copolymers, polyvinylchloride, vinylchloride and vinyl acetate copolymers, acrylate copolymers, alkyd resins, cellulosic film formers, poly(amideimide), styrene-butadiene copolymers, vinylidenechloride-vinylchloride copolymers, vinylacetate-vinylidenechloride copolymers, styrene-alkyd resins, polyvinylcarbazole, and the like. These polymers may be block, random or alternating copolymers.

The photogenerating composition or pigment is present in the resinous binder composition in various amounts, generally, however, from about 5 percent by volume to about 90 percent by volume of the photogenerating pigment is dispersed in about 10 percent by volume to about 95 percent by volume of the resinous binder, and preferably from about 20 percent by volume to about 30 percent by volume of the photogenerating pigment is dispersed in about 70 percent by volume to about 80 percent by volume of the resinous binder composition. In one embodiment about 8 percent by volume of the photogenerating pigment is dispersed in about 92 percent by volume of the resinous binder composition.

The photogenerating layer containing photoconductive compositions and/or pigments and the resinous binder material generally ranges in thickness of from about 0.1 micrometer to about 5.0 micrometers, and preferably has a thickness of from about 0.3 micrometer to about 3 micrometers. The photogenerating layer thickness is related to binder content. Higher binder content compositions generally require thicker layers for photogeneration. Thicknesses outside these ranges can be selected providing the objectives of the present invention are achieved.

Any suitable and conventional technique may be utilized to mix and thereafter apply the photogenerating layer coating mixture. Typical application techniques include spraying, dip coating, roll coating, wire wound rod coating, and the like. Drying of the deposited coating may be effected by any suitable conventional technique such as oven drying, infra red radiation drying, air drying and the like.

The active charge transport layer of this invention comprises a mixture of at least a charge transporting small molecule dissolved or molecularly dispersed in a film forming charge transporting polymer comprising charge transporting moieties in the backbone of the film forming charge transporting polymer, the charge transporting moieties having a structure unlike the structure of the charge transporting small molecule, and the charge transport layer being substantially free of electrically inactive film forming binder.

For embodiments of this invention where the active charge transport polymer having charge transporting moieties in the backbone is represented by the following formula:

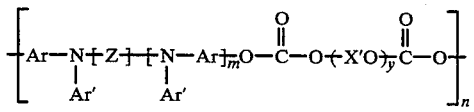

wherein:

m is 0 or 1, n is between about 5 and about 5,000,

Z is selected from the group consisting of:

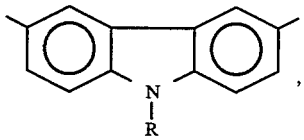

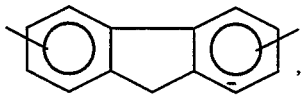

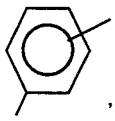

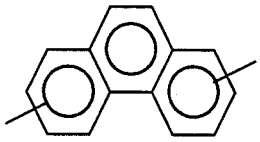

and $-Ar-(X)_n-Ar-$ n is 0 or 1,

Ar is selected from the group consisting of:

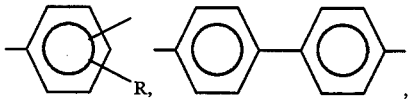

and

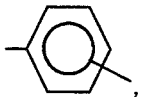

R is an alkylene radical selected from the group consisting of alkylene and iso-alkylene groups containing 2 to 10 carbon atoms, Ar' is selected from the group consisting of:

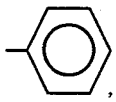

-continued

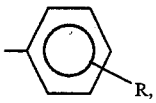

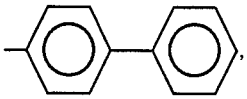

and

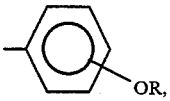

X is selected from the group consisting of:

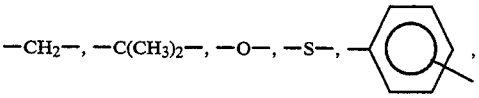

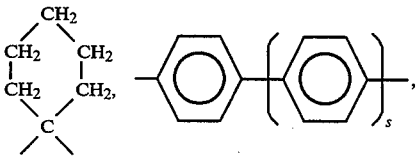

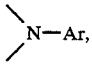

and

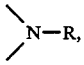

s is 0, 1 or 2, and

X' is an alkylene radical selected from the group consisting of alkylene and iso-alkylene groups containing 2 to 10 carbon atoms.

If the ionization potential ($I_p$) of the charge transporting small molecule is equal to the ionization potential ($I_p$) of the charge transporting polymer, the proportion of the charge transporting small molecule is between about 20 percent by weight and about 80 percent by weight based on the total weight of the charge transporting layer with the other substantially making up the remainder. Outside of these ranges, the photoreceptor film forming characteristics may not be suitable from mechanical considerations and/or from the point of view of compatibility where the small molecule might crystallize thereby resulting in high residual potentials. Where the ionization potentials of the charge transporting small molecule is less than the ionization potential of the charge transporting polymer, the charge transporting layer should contain between 30 percent and about 80 percent by weight of the small molecule charge transporting compound based on the total weight of the charge transporting layer because, in this case, the lower limit is set by charge carrier mobility requirements and the higher limit is set by considerations of small molecule crystallization. When the ionization potentials are unequal and if the small molecule is present in an amount less than 30 percent, the charge carrier mobilities are severely restricted. If the ionization potential of the charge transporting small molecule is less by a factor of more than about 2kT–3kT (where k is the Boltzmann Constant and T is the absolute temperature) than the ionization potential of the charge transporting polymer, the concentration of the charge transporting small molecule should be much higher because if this requirement is not met, the charge carrier mobility is considerably reduced as a result of the lower ionization material acting as a trap to charge transport through the higher ionization material. The term "much higher" means that the small molecular concentration is higher than 30 wt percent and the concentration of the active charge transport moiety of the charge transport polymer is less than 10 wt percent based on the total weight of the transport layer. Where the ionization potentials of the charge transporting small molecule and charge transporting polymer are unequal, a greater choice of solvents are available that are compatible with both the charge transport polymer and charge transporting small molecule. This in turn presents a greater choice of materials having different mechanical and/or surface properties. If the ionization potential of the charge transporting small molecule is greater than the ionization potential ($I_p$) of the charge transporting polymer, no enhanced benefit other than greater choice of solvents is observed with regard to using the combination of charge transporting small molecule and charge transporting polymer materials. The expression "Ionization potential ($I_p$)" as employed herein is defined as the energy required to raise an electron from the highest occupied state to a free state outside the material. Ionization potential may be determined by photo-emission, photo-electron spectroscopy, and the like. To determine whether the ionization potentials of the materials for a given combination are substantially equal, one can simply measure charge carrier mobility of one of the materials by the time of flight technique, mix the charge transporting polymer and small molecule charge transporting compound together and then measure the time of flight of the mixture. If the $I_p$ of each of the components of the mixture are not substantially equal, a drop in the drift mobility of at least about two or more is detected. The time of flight technique consists of applying a known potential on the layered device with a semi-transparent vacuum deposited metal electrode. The device is then exposed to a light flash. Holes photogenerated in the charge generator layer are injected into the charge transport layer. The current due to the drift of the sheet of holes through the transport layer is time resolved. From the transit time ($t_T$ in seconds), the drift mobility ($\mu$ in $CM^2$/Volt sec)is calculated from the expression ($\mu = L^2/t_T V$), where L is the thickness of the transport layer in centimeters and V is the potential in volts.

Any suitable charge transporting or electrically active small molecule may be employed in the charge transport layer of this invention. Typical charge transporting small molecules include, for example, pyrazolines such as 1-phenyl-3(4'-diethylamino styryl)-5-(4''-diethylamino phenyl) pyrazoline, diamines such as N,N'-diphenyl-N,N'-bis(3-methylphenyl)-(1,1'-biphenyl)-4,4'-diamine, hydrazones such as N-phenyl-N-methyl-3-(9-ethyl) carbazyl hydrazone and 4, diethyl amino benzaldehyde- 1,2 diphenyl hydrazone and oxadiazoles such as 2,5-bis (4-N,N' diethylaminophenyl)-1,2,4-oxadiazole, triphenyl methanes such as Bis (4,N,N-diethylamino-2-methyl phenyl)-phenyl methane, stilbenes and the like. These electrically active small molecule charge transporting compounds should dissolve or molecularly disperse in electrically active charge transporting polymeric materials. The expression "charge transporting small molecule" as employed herein are defined as a monomeric chemical molecular species capable of supporting charge transport when dispersed in an electrically inactive organic resinous binder matrix. The expression "electrically active" when used to define the charge transport layer, the electrically active small molecule charge transporting compounds and the electrically active charge transporting polymeric materials means that the material is capable of supporting the injection of photogenerated holes from the generating material and capable of allowing the transport of these holes through the active transport layer in order to discharge a surface charge on the active layer. The expression "electrically inactive ", when used to describe the electrically inactive organic resinous binder material which does not contain any electrically active moiety, means that the binder material is not capable of supporting the injection of photogenerated holes from the generating material and is not capable of allowing the transport of these holes through the material.

Still other examples of electrically active small molecule charge transporting compounds include aromatic amine compounds represented by the following general formula:

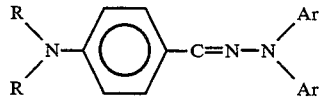

whereing R is slected from the group consisting of an alkyl group containing from 1 to 4 carbon atoms and Ar. Ar is selected from the group consisting of:

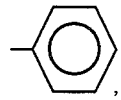

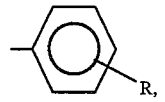

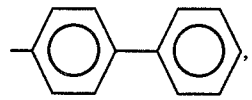

and

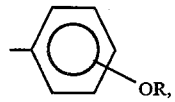

Examples of small molecule charge transporting aromatic amines represented by the structural formula above capable of supporting the injection of photogenerated holes and transporting the holes through the layer include N-ethyl-3-carbazolecarboxaldehyde-N-phenyl-N-methylhydrazone and 4-diethylamino benzaldehyde-N,N-diphenyl hydrazone.

Still other examples of aromatic diamine small molecule charge transport layer compounds include those represented by the general formula:

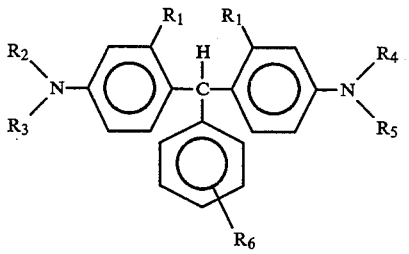

wherein $R_1$ is selected from the group consisting of hydrogen and $CH_3$ and $R_2$, $R_3$, $R_4$, $R_5$ and $R_6$ are selected from the group consisting of an alkyl group containing from 1 to 4 carbon atoms and Ar. Ar is selected from the group consisting of:

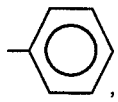

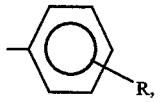

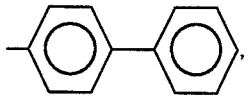

and

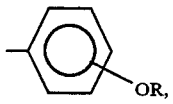

Examples of this family of transporting small molecules include Bis(4-N,N-diethylamino-2-methyl phenyl)-phenyl methane, Bis(4-N-p-tolyl-N-ethylamino-3-methyl phenyl)-phenylmethane and Bis(4-N,N-diethylamino-2-methyl phenyl)-penylmenthane and Bis(4-N,N-diethylamino-2-methyl phenyl)-4-methylphenyl methane.

Any suitable charge transporting polymer may be utilized in the charge transporting layer of this invention. These electrically active charge transporting polymeric materials should be capable of supporting the injection of photogenerated holes from the charge generation material and capable of allowing the transport of these holes therethrough. The expression "charge transporting moieties" of the film forming charge transporting polymer as employed herein is defined as one of the "active" units or segments that support charge transport. The charge transporting moiety of the film forming charge transporting polymer is considered to have a structure "unlike" the structure of the charge transporting small molecule when the basic or core structural units that transport charge are dissimilar. Minor differences such as the presence of substantially inactive groups such as methyl, ethyl, propyl, isopropyl, and butyl groups present on the basic structural unit of the charge transporting moiety of the polymer or the small molecule charge transporting compound and not on the other, do not bring otherwise identical structures within the definition of "unlike". The presence of other groups on either the charge transporting moiety of the polymer or on the small molecule charge transporting compound, but not on the other, which significantly affect the electrical properties of the polymer or small molecule, such as electron withdrawing groups, alkoxy groups, and the like, are included within the definition of unlike chemical structures. Electrical properties that are considered significantly affected include, for example, charge carrier mobilities, trapping characteristics, color and the like. Typical electron withdrawing groups include nitro groups, cyano groups, alkoxy, and the like. Typical charge transporting polymers include polymethylsilylene and the like. Still other examples of charge transporting polymers include arylamine compounds represented by the formula:

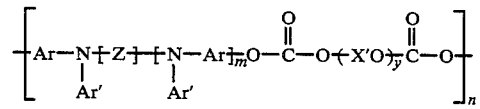

wherein:

m is 0 or 1, n is between about 5 and about 5,000,

Z is selected from the group consisting of:

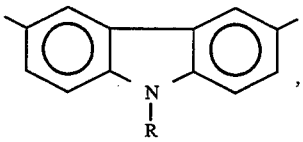

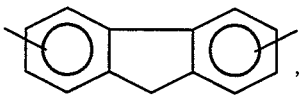

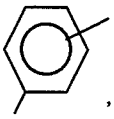

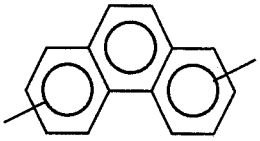

and $-Ar-(X)_n-Ar-$ n is 0 or 1,

Ar is selected from the group consisting of:

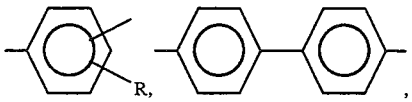

and

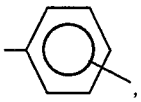

R is an alkylene radical selected from the group consisting of alkylene and iso-alkylene groups containing 2 to 10 carbon atoms, Ar' is selected from the group consisting of:

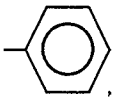

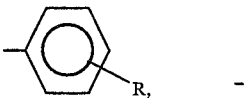

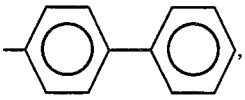

and

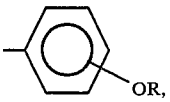

X is selected from the group consisting of:

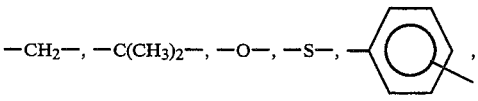

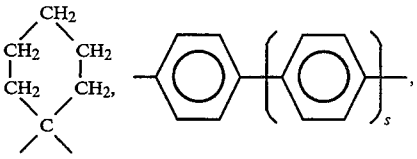

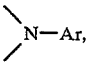

and

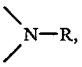

s is 0, 1 or 2, and

X' is an alkylene radical selected from the group consisting of alkylene and iso-alkylene groups containing 2 to 10 carbon atoms. A typical charge transporting polymers represented by the above formula is:

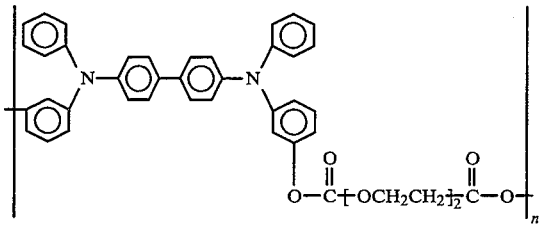

Wherein the value of n is between about 10 and about 1,000. These and other charge transporting polymers represented by the above generic formulā are described in U.S. Pat. No. 4,806,443, the entire disclosure thereof being incorporated herein by reference.

Other typical charge transporting polymers include arylamine compounds represented by the formula:

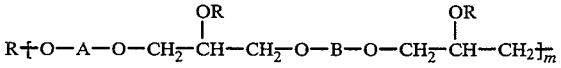

wherein:

R is selected from the group consisting of —H, —$CH_3$, and —$C_2H_5$;

m is between about 4 and about 1,000; and

A is selected from the group consisting of an arylamine group represented by the formula:

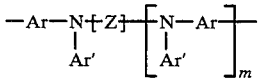

wherein:

m is 0 or 1,

Z is selected from the group consisting of:

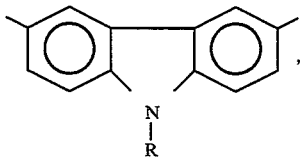

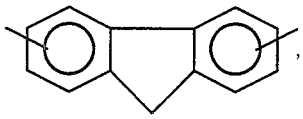

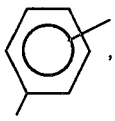

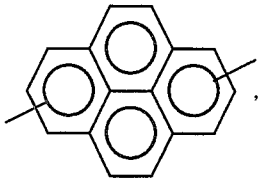

-continued and $-Ar-(X)_n-Ar-$ wherein:

n is 0 or 1,

Ar is selected from the group consisting of:

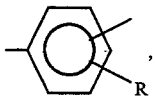

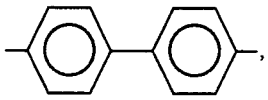

and

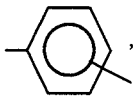

wherein:

R′ is selected from the group consisting of $-CH_3$, $-C_2H_5$, $-C_3H_7$, and $-C_4H_9$, Ar′ is selected from the group consisting of:

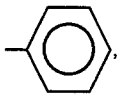

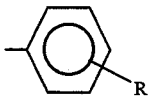

and

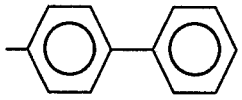

X is selected from the group consisting of:

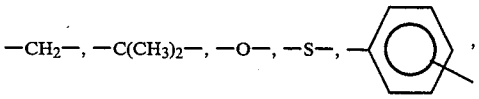

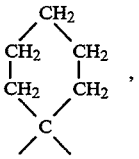

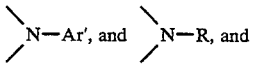

B is selected from the group consisting of:

the arylamine group as defined for A, and $-Ar\langle V\rangle_n Ar-$ wherein Ar is as defined above, and V is selected from the group consisting of:

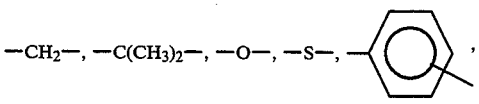

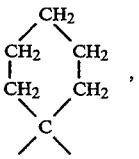

and n is 0 or 1. Specific examples include:

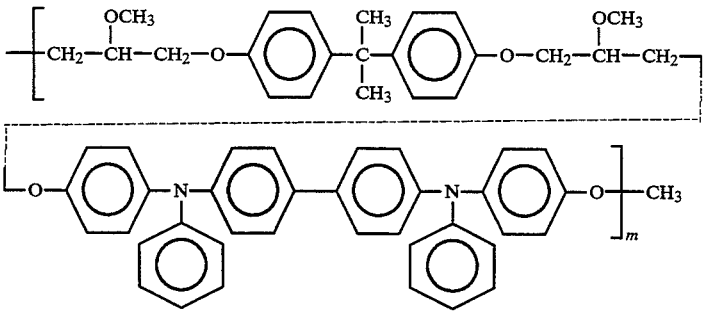

where the value of m was between about 18 and about 19 and

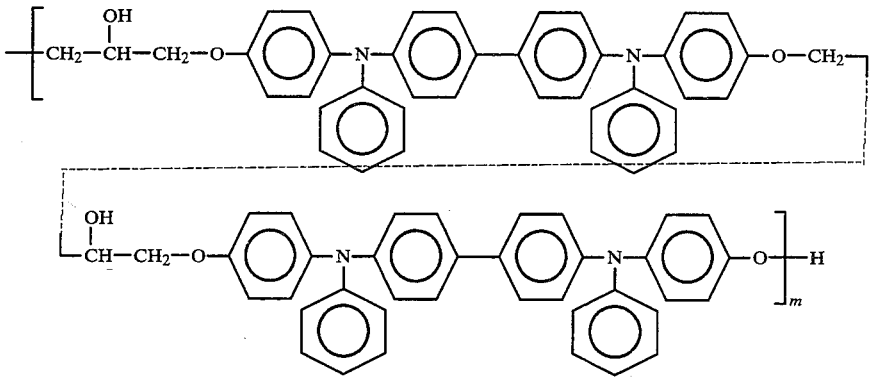

where the value of m was between about 4 and about 5. These and other charge transporting polymers represented by the above generic formula are described in U.S. Pat. No. 4,818,650 and U.S. Pat. No. 4,956,440, the entire disclosures thereof being incorporated herein by reference.

An example of still other typical charge transporting polymers is:

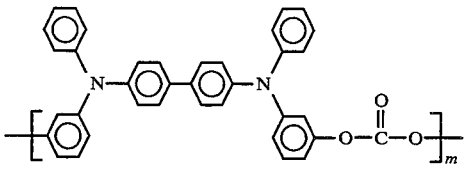

wherein the value of m was between about 10 and about 50. This and other related charge transporting polymers are described in U.S. Pat. No. 4,806,444 and U.S. Pat. No. 4,956,487, the entire disclosures thereof being incorporated herein by reference.

Other examples of typical charge transporting polymers are:

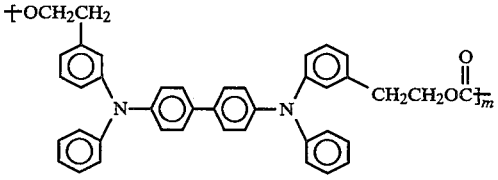

2m pyridine HCl wherein m is between about 10 and about 10,000 and

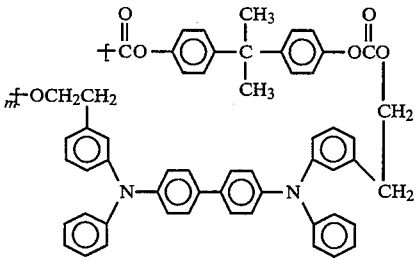

wherein m is between about 10 and about 1,000. Related charge transporting polymers include copoly [3,3' bis(hydroxyethyl)triphenylamine/bisphenolA]carbonate, copoly [3,3' bis(hydroxyethyl)tetraphenylbezidine/bisphenolA]carbonate, poly[3,3' bis(hydroxyethyl)tetraphenylbenzidine]carbonate, poly [3,3' bis(hydroxyethyl)triphenylamine]carbonate, and the like. These charge transporting polymers are described in U.S. Pat. No. 4,401,517, the entire disclosure thereof being incorporated herein by reference.

Further examples of typical charge transporting polymers include:

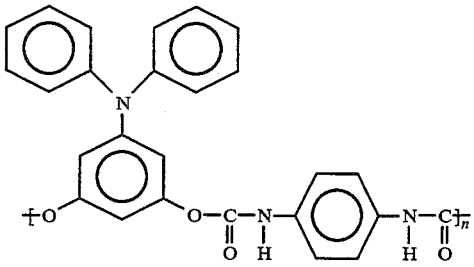

where n is between about 5 and about 5,000;

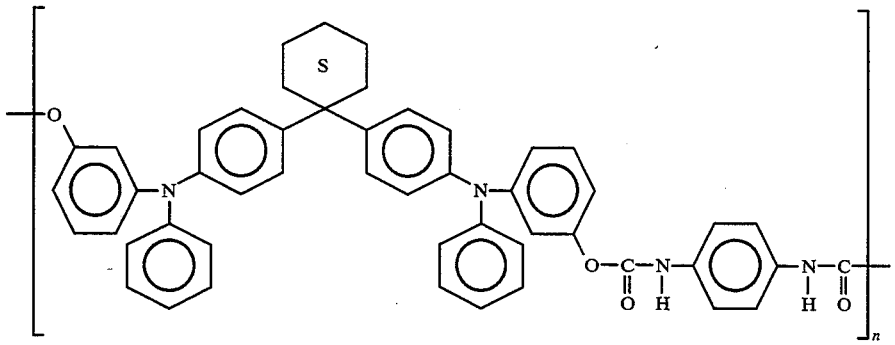

where n represents a number sufficient to achieve a weight average molecular weight of between about 20,000 and about 500,000;

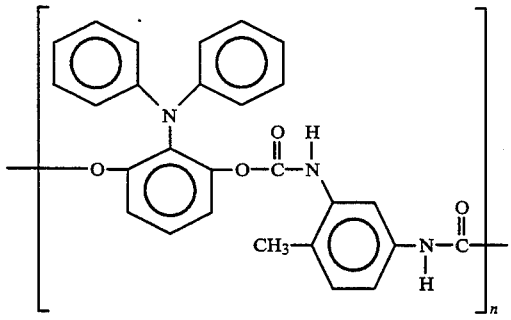

where n represents a number sufficient to achieve a weight average molecular weight of between about 20,000 and about 500,000; and

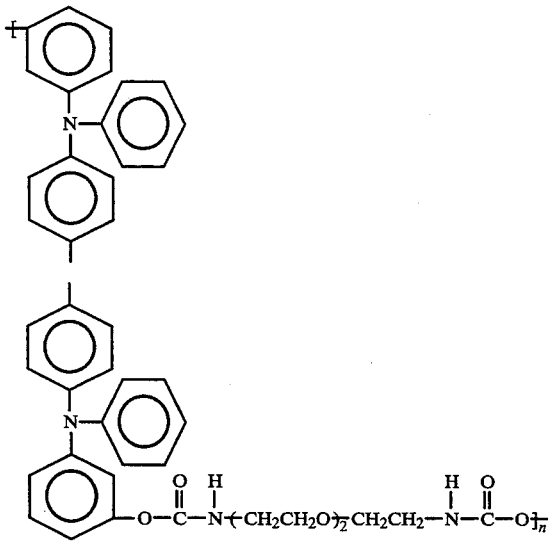

where n represents a number sufficient to achieve a weight average molecular weight of between about 20,000 and about 500,000. These and other related charge transporting polymers are described in copending U.S. application Ser. No. 07/512,231 filed Apr. 20, 1990, now U.S. Pat. No. 5,030,532, issued Jul. 9, 1991, the entire disclosure thereof being incorporated herein by reference.

As described above, the active charge transport layer of this invention comprises a mixture of at least a charge transporting small molecule dissolved or molecularly dispersed in a film forming charge transporting polymer comprising charge transporting moieties in the backbone of the film forming charge transporting polymer, the charge transporting moieties having a structure unlike the structure of the charge transporting small molecule, and the charge transport layer being substantially free of electrically inactive film forming binder. The charge transport polymer in the charge transporting layer of this invention should contain charge transporting moieties having a structure unlike the structure of the small molecule charge transport compound dissolved or molecularly dispersed in the charge transport polymer. Significant differences in the core structures themselves render the structure of the charge transporting moiety of the film forming charge transporting polymer "unlike" the structure of the charge transporting small molecule. Typical examples of combinations of unlike materials include polymethyl phenylsilylene charge transport polymer and an aromatic diamine; polyether carbonate with diamine charge transporting molecules in the backbone and charge transporting hydrazones or stillbenes; and the like.

The combination of charge transport polymer and small molecule charge transport compound in the charge transport layer of this invention should be capable of supporting the injection of photogenerated holes from the generation material and capable of allowing the transport of these holes through the active layer in order to discharge the surface charge on the active layer. The charge transport polymer and the charge transport small molecule should also be miscible in each other. The expression "miscible" is defined as a mixture which forms a solution or molecular dispersion of the small molecule transport compound in the charge transport polymer. Examples of typical combinations of unlike charge transporting polymer and charge transporting small molecule include, for example polymethyl phenylsilylene and small molecules of N,N'-diphenyl-N,N'-bis(3-methylphenyl)-(1,1'-biphenyl)-4,4'-diamine; or polyethercarbonate obtained from the condensation of N,N'-diphenyl-N,N'-bis(3-hydroxy phenyl)-[1,1'-biphenyl]-4,4'-diamine and diethylene glycol bischloroformate and small molecule 1,1-bis-(4-(di-N,N'-methylphenyl)-aminophenyl)cyclohexane; or polyethercarbonate obtained from the condensation of 1,1-bis-(4-(di-N,N'-hydroxy phenyl)aminophenyl)cyclohexane and diethylene glycol bischloroformate and small molecule, N,N'-diphenyl-N,N'-bis(3-methylphenyl)-(1,1'-biphenyl)-4,4'-diamine; and the like. These combinations involve a charge transporting small molecule having an ionization potential substantially equal to or less than the ionization potential of the charge transporting polymer or combinations. For example, where a pyrazoline small molecule having an $I_p$ less than the $I_p$ of an aryl diamine small charge transporting moiety of a charge transporting polymer is mixed with a charge transporting polymer containing a high (greater than 10 weight percent) concentration of diamines, the resulting layer will not perform properly as a charge transport layer because mobility is reduced due to charge trapping. However, a layer formed from a mixture of pyrazoline small molecule and charge transporting polymer containing a relatively small quantity (less than 10 weight percent) of aryl diamine small charge transporting moiety gives satisfactory charge mobility along with the added advantage of solubility in other solvents, better mechanical property, improved resistance to wear, enhanced bending characteristics without cracking properties and improved surface properties. A charge transporting small molecule is deemed to have an ionization potential "substantially equal" to the ionization potential of the polymer when the difference in ionization potential value is less than about 0.05 electron volt. The concentration of the combined mixture of the charge transporting small molecule and charge transporting polymer in the charge transport layer relative to any other components in the layer should be at least about 90 per cent because any anti oxidants or plasticizers that may be present in a concentration higher than about 10 percent by weight would not contribute to charge transport and would lower the charge carrier mobilities when present in concentrations greater than about 10 percent.

The charge transport layer should be substantially free of any electrically inactive film forming resin binder material. The presence of an electrically inactive film forming resin binder material will cause the photoreceptor to have lower mobilities, and might even result in phase separation and this will result in unacceptably high residual potentials. The expression "substantially free" as employed herein is defined as a presence of less than about 5 percent.

Any suitable and conventional technique may be utilized to mix and thereafter apply the charge transport layer coating mixture to the charge generating layer. Typical application techniques include spraying, dip coating, roll coating, wire wound rod coating, and the like. Drying of the deposited coating may be effected by any suitable conventional technique such as oven drying, infra red radiation drying, air drying and the like.

Generally, the thickness of the hole transport layer is between about 10 to about 50 micrometers, but thicknesses outside this range can also be used. The hole transport layer should be an insulator to the extent that the electrostatic charge placed on the hole transport layer is not conducted in the absence of illumination at a rate sufficient to prevent formation and retention of an electrostatic latent image thereon. In general, the ratio of the thickness of the hole transport layer to the charge generator layer is preferably maintained from about 2:1 to 200:1 and in some instances as great as 400:1. In other words, the charge transport layer, is substantially nonabsorbing to visible light or radiation in the region of intended use but is "active" in that it allows the injection of photogenerated holes from the photoconductive layer, i.e., charge generation layer, and allows these holes to be transported through the active charge transport layer to selectively discharge a surface charge on the surface of the active layer.

The photoreceptors of this invention may comprise, for example, a charge generator layer sandwiched between a conductive surface and a charge transport layer as described above or a charge transport layer sandwiched between a conductive surface and a charge generator layer. This structure may be imaged in the conventional xerographic manner which usually includes charging, optical exposure and development.

Other layers may also be used such as conventional electrically conductive ground strip along one edge of the belt or drum in contact with the conductive layer, blocking layer, adhesive layer or charge generating layer to facilitate connection of the electrically conductive layer of the photoreceptor to ground or to an electrical bias. Ground strips are well known and usually comprise conductive particles dispersed in a film forming binder.

Optionally, an overcoat layer may also be utilized to improve resistance to abrasion. In some cases an anticurl back coating may be applied to the side opposite the photoreceptor to provide flatness and/or abrasion resistance. These overcoating and anti-curl back coating layers are well known in the art and may comprise thermoplastic organic polymers or inorganic polymers that are electrically insulating or slightly semiconductive. Overcoatings are continuous and generally have a thickness of less than about 10 micrometers.

The transport layers of this invention exhibit numerous advantages; in the embodiment where the ionization potential $I_p$ of the small molecule is substantially equal to the $I_p$ of the charge transporting polymer, charge carrier mobilities are increased unexpectedly beyond that which can be achieved with either charge transporting polymer layers or with layers containing charge transporting small molecules in an electrically inactive transport binder. In the embodiment where the ionization potentials are unequal, by using small amounts of the active charge transporting moiety in a polymer molecule, the concept of this invention enables one to use larger amounts of binder material in the same molecule to expand the choice of physical properties, e.g, greater flexibility for use in flexible belts. The transport layers of this invention also overcome the tendency of charge transporting small molecules to crystallize at high concentrations. For, multi active layer photoreceptors employing diamine charge transporting small molecules in inactive polycarbonate binders, at the concentration level of small molecule required to provide adequate transport properties, the system can be thermodynamically unstable during some coating processes. This has been observed with the dip coating process where the maximum concentration of diamine charge transporting small molecules, before the onset of crystallization, is less than 35 percent by weight in the final dried charge transport layer. This concentration is too low to assure charge transport across a 25 micrometer thick film in time periods shorter than the time interval between exposure and development. The charge transporting polymers employed in the charge transport layer of this invention provide a good dispersing medium for the charge transporting small molecule, and exhibit better mechanical properties than conventional electrically inactive film forming binders such as polycarbonates.

A shortcoming of many charge transporting small molecules is that there are very few inactive binders in which charge transporting small molecules disperse at high concentrations without crystallization. Polycarbonate is one of the few binders in which charge transporting small molecules disperse to form stable solid solutions. Polycarbonate is soluble in a very limited set of solvents. Methylene chloride is invariably employed to fabricate the current small molecule transport layers. The presence of a relatively small percent of moieties of charge transporting segments (units) in the backbone of the charge transport polymer (e.g., less than about 10 percent by weight based on the total weight of the polymer) enables the use of a variety of different solvents other than the conventional polycarbonate film forming binder to be used to apply the charge transporting layer. The use of different solvents is important to the providing of flexibility in selection of coating techniques such as wire wound rod coating which requires dilute concentrations and dip coating which utilizes high concentrations of film forming binder in the coating solution. Also, since a greater selection of solvents are available, undesirable solvents such as toxic solvents can be avoided. Further, crystallization of small molecule charge transport material can be avoided even when high concentrations of small molecules are utilized.

A problem encountered with employing transport layers of charge transporting polymers is the restriction it imposes on the design of the generator layer. Since the transport polymer does not penetrate the charge generation layer, particle contact type generator materials are preferred. The photogenerated charge from the pigment moves from one pigment particle to the next till it is injected into the polymeric transport layer. The combination transport layer of this invention does not so restrict the generator layer geometry. Dispersed pigment generators can readily be employed with the transport layer of this invention. The charge transporting small molecules from the transport layers of this invention penetrate the generator layers and facilitate charge injection from the pigment.

A number of examples are set forth hereinbelow and are illustrative of different compositions and conditions that can be utilized in practicing the invention. All proportions are by weight unless otherwise indicated. It will be apparent, however, that the invention can be practiced with many types of compositions and can have many different uses in accordance with the disclosure above and as pointed out hereinafter.

EXAMPLE I

An aluminum plate bearing a vacuum deposited 0.5 micrometer thick layer of amorphous selenium was coated with a solution containing one gram of polyethercarbonate resin and 0.667 gram of bis(4-diethylamino-2-methylphenyl)-phenylmethane dissolved in 11.5 grams of methylene chloride solvent using a Bird coating applicator. The polyethercarbonate resin was prepared as described in Example III of U.S. Pat. No. 4,806,443. This polyethercarbonate resin is an electrically active charge transporting film forming binder and can be represented by the formula:

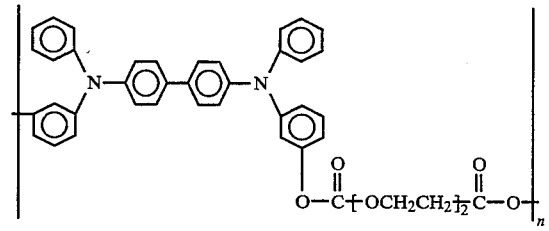

wherein n is about 300 in the above formula so that the molecular weight of the polymer is about 200,000. The coated device was dried at 35° C. under vacuum for 12 hours to form a 20 micrometer thick charge transport layer containing 40% by weight of bis(4-diethylamino-2-methylphenyl)phenylmethane. A vacuum chamber was employed to deposit a semitransparent gold electrode on top of the device. The resulting sandwich device was connected to an electrical circuit containing a power supply and a current measuring resistance. The transit time of the charge carriers was determined by the time of flight technique. This was accomplished by biassing the gold electrode negative and exposing the device to a brief flash of light. Holes photogenerated in amorphous selenium were injected into and transited through the transport layer. The current due to the transit of a sheet of holes was time resolved and displayed on an oscilloscope. The current pulse displayed on the oscilloscope comprised a curve having flat segment followed by a rapid decrease. The flat segment was due to the transit of the sheet of holes through the transport layer. The rapid drop of current signaled the arrival of the holes at the gold electrode. From the transit time, the velocity of the carriers was calculated by the relationship:

$$\text{velocity} = \text{transport layer thickness} \div \text{transit time}$$

The hole mobility is related to the velocity by the relationship:

$$\text{velocity} = (\text{mobility}) \times (\text{electric field})$$

The mobility of this dispersion of polyethercarbonate and bis(4-diethylamino-2-methylphenyl)-phenylmethane in the transport layer was determined to be $3 \times 10^{-4}$ cm$^2$/volt sec at an applied electric field of $2 \times 10^5$ V/cm. This mobility value is unexpectedly high and suggests very good charge transport.

EXAMPLE II

An aluminum plate bearing a vacuum deposited 0.5 micrometer thick layer of amorphous selenium was coated with a solution containing one gram of poly(methylphenyl silylene) and 0.667 grams of bis(4-diethylamino-2-methylphenyl)-phenylmethane are dissolved in 22 grams of toluene using a Bird coating applicator. The coated device was dried at 24° C. under vacuum for 12 hours to form a 20 micrometer thick charge transport layer consisting of 40 percent by weight bis(4-diethylamino-2-methylphenyl)-phenylmethane in poly(methylphenyl silylene). A vacuum chamber was employed to deposit a semitransparent gold electrode on top of the device. This sandwich device was connected in an electrical circuit containing a power supply and a current measuring resistance. The transit time of the charge carriers was determined by the time of flight technique. The mobility of this dispersion of bis(4-diethylamino-2-methylphenyl)phenylmethane in poly(methylphenyl silylene) was $2.5\times10^{-4}$ $cm^2$/volt sec at an applied electric field of $2\times10^5$ V/cm. This mobility value is unexpectedly high and suggests very good charge transport.

EXAMPLE III

An aluminum plate bearing a vacuum deposited 0.5 micrometer layer of amorphous selenium was coated with a solution containing one gram of polyethercarbonate (identical to the polyethercarbonate described in Example I) and 0.667 gram of p-diethylamino-benzaldehyde-diphenyl hydrazone dissolved in 11.5 grams of methylene chloride using a 4 mil Bird coating applicator. The coated device was dried at 24° C. under vacuum for 12 hours to form a 20 micrometer thick charge transport layer of polyethercarbonate mixed with 40 percent by weight of p-diethylamino-benzaldehyde-diphenyl hydrazone. A vacuum chamber was employed to deposit a semitransparent gold electrode on top of the device. The resulting sandwich device was connected in an electrical circuit containing a power supply and a current measuring resistance. The transit time of the charge carriers was determined by the time of flight technique. The mobility of this polyethercarbonate and p-diethylamino-benzaldehyde-diphenyl hydrazone transport layer was determined to be $3\times10^{-6}$ $cm^2$/volt sec at an applied electric field of $2\times10^5$ V/cm. The mobility value suggests that polyether carbonate acts essentially as an inert binder for p-diethylamino-benzaldehyde-diphenyl hydrazone.

EXAMPLE IV

A photoreceptor was prepared by forming coatings using conventional techniques on a substrate comprising a vacuum deposited titanium layer on a polyethylene terephthalate film (Melinex ®, available from E. I. duPont de Nemours & Co.). The first deposited coating was a siloxane barrier layer formed from hydrolyzed gamma aminopropyltriethoxysilane having a thickness of 100 angstroms. The second coating was an adhesive layer of polyester resin (49,000, available from E. I. duPont de Nemours & Co.) having a thickness of 50 angstroms. The next coating was a charge generator layer containing 35 percent by weight vanadyl phthalocyanine particles dispersed in a polyester resin (Vitel ® PE100, available from Goodyear Tire and Rubber Co.) having a thickness of 1 micrometer. The last coating was a charge transport layer consisting of a 20 micron thick layer of polyethercarbonate (identical to the polyethercarbonate described in Example I) mixed with 40 percent by weight bis(4-diethylamino-2-methylphenyl)-phenylmethane fabricated by the procedure indicated in Example I. The resulting device was heated in a vacuum oven maintained at 80° C. Sensitivity measurements were performed in a scanner. The photoreceptor device was mounted on a cylindrical aluminum drum which was rotated on a shaft. The film was charged by a corotron mounted along the perimeter of the drum. The surface potential of the photoreceptor was measured as a function of time by several capacitively coupled probes placed at different locations around the perimeter of the drum. The probes were calibrated by applying known potentials to the drum substrate. The photoreceptor film on the drum was exposed and erased by light sources located at appropriate positions around the periphery of the drum. The measurement involved charging the photoconductor device in a constant current or voltage mode. As the drum rotated, the initial charging potential was measured by probe 1. Further rotation lead to the exposure station, where the photoconductor device was exposed to monochromatic radiation of a known intensity. The surface potential after exposure was measured by probes 2 and 3. The device was finally exposed to an erase lamp of appropriate intensity and any residual potential was measured by probe 4. The process was repeated with the magnitude of the exposure automatically changed during the next cycle. A photo induced discharge characteristics (PIDC) curve was obtained by plotting the potentials at probes 2 and 3 as a function of exposure. The device was charged to a negative polarity by corotron charging and discharged by monochromatic light in the visible and in the IR portion of the light spectrum. The device initially charged to 850 volts could be discharged to less than 150 Volts when exposed to 775 nm wavelength light with a light energy of 10 ergs/$cm^2$.

EXAMPLE V

A photoreceptor was prepared by forming coatings using conventional techniques on a substrate comprising a vacuum deposited titanium layer on a polyethylene terephthalate film (Melinex ®, available from E. I. duPont de Nemours & Co.). The first coating deposited was a siloxane barrier layer formed from hydrolyzed gamma aminopropyltriethoxysilane having a thickness of 100 angstroms. The second coating was an adhesive layer of polyester resin (49,000, available from E. I. duPont de Nemours & Co.) having a thickness of 50 angstroms. The next coating was a charge generator layer containing 35 percent by weight vanadyl phthalocyanine particles dispersed in a polyester resin (Vitel ® PE100, available from Goodyear Tire and Rubber Co.) having a thickness of 1 micrometer. The last coating was a charge transport layer consisting of a 20 micrometer thick layer of a mixture of 40 percent by weight of bis(4-diethylamino-2-methylphenyl)-phenylmethane in poly(methylphenyl silylene) fabricated by the procedure described in Example II. The resulting device was heated in a vacuum oven maintained at 80° C. Sensitivity measurements were performed in a scanner described in Example IV. The photoreceptor device, initially charged to 850 volts by a negative polarity corotron, was discharged to less than 150 volts when exposed to 775 nm wavelength light with a light energy of 10 ergs/$cm^2$.

EXAMPLE VI

A photoreceptor was prepared by forming coatings using conventional techniques on a substrate comprising a vacuum deposited titanium layer on a polyethylene terephthalate film (Melinex ®, available from E. I. duPont de Nemours & Co.). The first coating was a siloxane barrier layer formed from hydrolyzed gamma aminopropyltriethoxysilane having a thickness of 100 angstroms. The second coating was an adhesive layer of polyester resin (49,000, available from E. I. duPont de Nemours & Co.) having a thickness of 50 angstroms. The next coating was a charge generator layer containing 35 percent by weight vanadyl phthalocyanine particles dispersed in a polyester resin (Vitel ® PE 100, available from Goodyear Tire and Rubber Co.) having a thickness of 1 micrometer. The charge transport layer consisted of a 20 micrometer thick film of polyethercarbonate described in Example I) mixed with 40 percent by weight of p-diethylamino-benzaldehyde-diphenyl hydrazone fabricated by the procedure indicated in Example III. The device was heated in a vacuum oven maintained at 30° C. Sensitivity measurements were performed in a scanner described in Example IV. The photoreceptor device, initially charged to 850 volts by a negative polarity corotron, was discharged to less than 150 volts when exposed to 775 nm wavelength light with a light energy of 10 ergs/cm$^2$.

Although the invention has been described with reference to specific preferred embodiments, it is not intended to be limited thereto, rather those skilled in the art will recognize that variations and modifications may be made therein which are within the spirit of the invention and within the scope of the claims.

What is claimed is:

1. An electrophotographic imaging member comprising a charge generating layer and a charge transport layer, said charge transport layer comprising a charge transporting small molecule dissolved or molecularly dispersed in a film forming charge transporting polymer comprising charge transporting moieties in the backbone of said film forming charge transporting polymer, said charge transporting moieties having a structure unlike the structure of said charge transporting small molecule, the ionization potential of said charge transporting small molecule and said charge transporting moieties having a difference in ionization potential value of less than about 0.05 electron volt, said charge transporting small molecule and said charge transporting polymer being non-absorbing to radiation in the region of intended use, said charge transport layer being substantially free of electrically inactive film forming binder, and said charge transporting polymer being represented by the general formula:

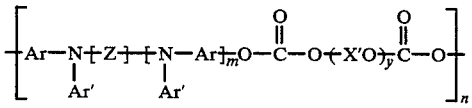

wherein:

m is 0 or 1 n is between about 5 and about 5,000,

Z is selected from the group consisting of:

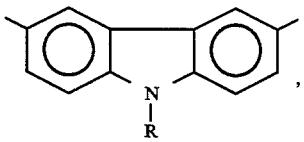

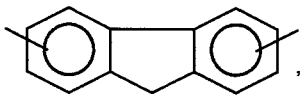

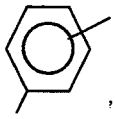

-continued

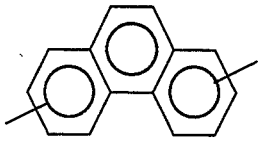

and $-Ar-(X)_n-Ar-$ n is 0 or 1,

Ar is selected from the group consisting of:

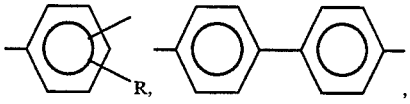

and

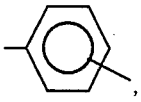

R is an alkylene radical selected from the group consisting of alkylene and iso-alkylene groups containing 2 to 10 carbon atoms, Ar′ is selected from the group consisting of:

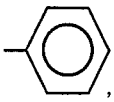

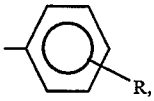

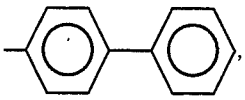

and

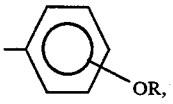

X is selected from the group consisting of:

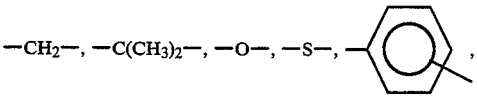

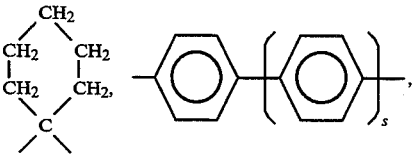

-continued

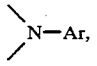

and

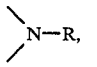

s is 0, 1 or 2,

X′ is an alkylene radical selected from the group consisting of alkylene and iso-alkylene groups containing 2 to 10 carbon atoms, and y is 1,2 or 3.

2. An electrophotographic imaging member according to claim 1 the proportion of said charge transporting small molecule is between about 20 percent by weight and about 80 percent by weight based on the total weight of said charge transporting layer with the other substantially making up the remainder.

3. An electrophotographic imaging member according to claim 2 wherein the concentration of said charge transporting moieties in the charge transporting polymer is between about 10 and about 75 weight percent based on the weight of said charge transporting polymer.

4. An electrophotographic imaging member according to claim 1 wherein the concentration of said charge transporting small molecule is higher than the concentration of said active charge transport moieties in said charge transporting polymer.

5. An electrophotographic imaging member according to claim 4 wherein said film forming charge transporting polymer comprises less than about 10 percent by weight of said charge transporting moieties based on the total weight of said charge transporting polymer.

6. An electrophotographic imaging member according to claim 1 wherein said film forming charge transporting polymer is an arylamine polymer.

7. An electrophotographic imaging member comprising a charge generating layer and a charge transport layer, said charge transport layer comprising a charge transporting small molecule dissolved or molecularly dispersed in a film forming arylamine charge transporting polymer comprising charge transporting moieties in the backbone of said film forming charge transporting polymer, said arylamine charge transporting moieties having a structure unlike the structure of said charge transporting small molecule, the ionization potential of said charge transporting small molecule and said charge transporting moieties having a difference in ionization potential value of less than about 0.05 electron volt, said charge transporting small molecule and said arylamine charge transporting polymer being non-absorbing to radiation in the region of intended use, and said charge transport layer being substantially free of electrically inactive film forming binder.

8. An electrophotographic imaging member according to claim 7 wherein said charge transporting small molecule is an aromatic amine charge transporting small molecule.

9. An imaging process comprising providing an electrophotographic imaging member comprising a charge generating layer and a charge transport layer, said charge transport layer comprising a charge transporting small molecule dissolved or molecularly dispersed in a film forming charge transporting polymer comprising charge transporting moieties in the backbone of said film forming charge transporting polymer, said charge transporting moieties having a structure unlike the structure of said charge transporting small molecule, said charge transporting moieties having a difference in ionization potential value of less than about 0.05 electron volt, said charge transporting small molecule and said charge transporting polymer being non-absorbing to radiation in the region of intended use and said charge transport layer being substantially free of electrically inactive film forming binder, said charge transporting polymer being represented by the general formula:

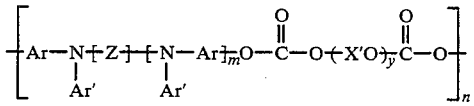

wherein:

m is 0 or 1 n is between about 5 and about 5,000,

Z is selected from the group consisting of:

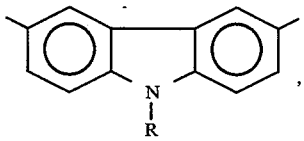

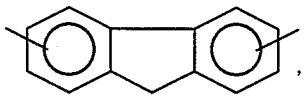

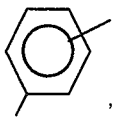

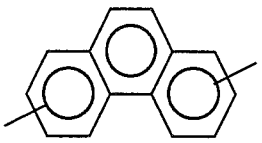

and $-Ar-(X)_n-Ar-$ n is 0 or 1,

Ar is selected from the group consisting of:

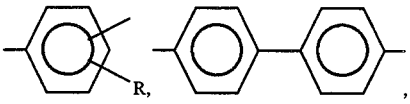

and

-continued

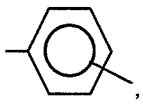

R is an alkylene radical selected from the group consisting of alkylene and iso-alkylene groups containing 2 to 10 carbon atoms, Ar′ is selected from the group consisting of:

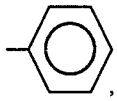

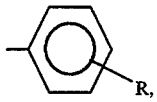

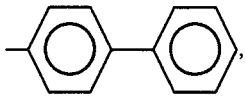

and

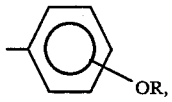

X is selected from the group consisting of:

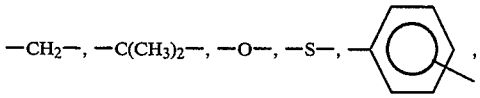

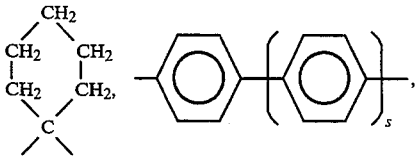

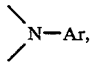

and

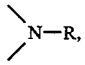

s is 0, 1 or 2,

X′ is an alkylene radical selected from the group consisting of alkylene and iso-alkylene groups containing 2 to 10 carbon atoms, and y is 1,2 or 3, and depositing a uniform electrostatic charge on said imaging member with a corona charging device, exposing said imaging member to activating radiation in image configuration to form an electrostatic latent image on said imaging member, developing said electrostatic latent image with electrostatically attractable marking particles to form a toner image, transfering said toner image to a receiving member and repeating said depositing, exposing, developing and transfering steps.

* * * * *